US006176723B1

(12) United States Patent
Sakata et al.

(10) Patent No.: US 6,176,723 B1
(45) **Date of Patent: *Jan. 23, 2001**

(54) ELECTRICAL CONNECTOR

(75) Inventors: Tsuyoshi Sakata; Satoshi Watanabe, both of Tokyo (JP)

(73) Assignee: Hirose Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/936,113

(22) Filed: Sep. 24, 1997

(30) Foreign Application Priority Data

Oct. 8, 1996 (JP) ..... 8-267124

(51) Int. Cl.[7] ..... H01R 13/62
(52) U.S. Cl. ..... 439/326; 439/630
(58) Field of Search ..... 439/326–328, 439/630–637, 59

(56) References Cited

U.S. PATENT DOCUMENTS 5,116,237 * 5/1992 Loewen ..... 439/326
5,511,985 * 4/1996 Noschese et al. ..... 439/637
5,567,171 * 10/1996 Mizuguchi ..... 439/326
5,779,507 * 7/1998 Yeh ..... 439/637

FOREIGN PATENT DOCUMENTS 63-193473 8/1988 (JP) .
7-211370 8/1995 (JP) .
7-288153 10/1995 (JP) .

* cited by examiner

*Primary Examiner*—Hien Vu
(74) *Attorney, Agent, or Firm*—Kanesaka & Takeuchi

(57) ABSTRACT

An electrical connector for connecting to a mother board a daughter board having a plurality of pads on a front edge and a hole, includes an insulation housing (221) to be mounted on the mother board and having a slot (225) for receiving the daughter board and a pair of front and rear rows of terminal receiving apertures (226); a plurality of lower and upper contact terminals (400, 500) provided in the front and rear terminal receiving apertures, respectively, such that a distance between lower and upper contact sections (519, 417) of the lower and upper contact terminals is equal to or slightly larger than a thickness of the front edge and that a vertical distance between the upper and lower contact sections before the daughter board is rotated rearwardly is smaller than that after the daughter board is rotated rearwardly, and that the upper and lower contact sections are brought into contact with the pads with a predetermined contact force.

4 Claims, 10 Drawing Sheets

ELECTRICAL CONNECTOR

BACKGROUND OF THE INVENTION

1. Field of the Invention

The present invention relates to electrical connectors for connecting daughter boards to mother boards and, especially, to DIMM type electrical connectors.

2. Description of the Related Art

An electrical connector for connecting a daughter board to a mother board includes an insulation housing to be mounted on the mother board and a plurality of contact terminals. The insulation housing includes a base and a pair of lock mechanism extending laterally from opposite ends of the base. A slot is provided in the base to receive a front edge of the daughter board and the contact terminals. The contact terminals are soldered to circuit traces of the mother board to secure the insulation housing. The daughter board is fitted into the insulation housing so that the front edge is supported by the slot and that the side edges are securely held by the lock mechanisms. Consequently, the pads of the daughter board are brought into contact with the contact terminals in the slot to connect the daughter board to the mother board.

The known types of electrical connector include dual-in-line memory module (DIMM) and single-in-line memory module (SIMM). In the DIMM type, the pads provided on the front and back sides of a daughter board are brought into contact with the contact terminals which are electrically separated. In the SIMM type, the pads provided on one side or both sides of a daughter board are brought into contact with the same contact terminal.

Examples of the electrical connectors are disclosed in Japanese patent application Kokai Nos. 288153/95 and 211370/95. In these examples, the lock mechanisms extend at right angles with the mother board. A daughter board is inserted from above along the grooves of the lock mechanisms. Projections are provided in the grooves to make them narrower for holding the daughter board between them. A plurality of contact terminals are provided in the base of an insulation housing to hold the front edge of the daughter board between them.

As the number of contact terminals increases, the insertion or removal force of a daughter board increases. Japanese patent application Kokai No. 193473/88 discloses a rotation-lock type electrical connector. In this electrical connector, the front edge of a daughter board is inserted obliquely into the slot of an insulation housing and then rotated rearwardly to a lock position to a mother board. This rotation-lock mechanism minimizes the insertion or removal force. A pair of claws are provided on the lock mechanisms to hook the daughter board, thereby minimizing the coming off of the daughter board.

However, in the rotation-lock mechanisms, the vertical distance between contact terminals on the front and back sides of a daughter board is so large that a large moment of rotation is applied to the daughter board, making the daughter board warped. The contact between the daughter board and the contact terminals is unstable, especially, for a large number of contact terminals or a large width of daughter boards.

The inventors have proposed a solution to the problem of the large vertical distance for the SIMM type connectors, but the problem with the DIMM type connector remains.

SUMMARY OF THE INVENTION

Accordingly, it is an object of the invention to provide an electrical connector which has a large number of contact terminals and permits insertion or removal of a daughter board with small force.

It is another object of the invention to provide a DIMM type electrical connector which has a small moment of rotation so that a daughter board suffers from no or little warping.

It is still another object of the invention to provide an electrical connector with an economical provision which prevents a daughter board from coming out of the connector.

According to the invention there is provided a rotation-lock type electrical connector which includes a slot and lower and upper contact terminals provided in the slot wherein the distance between the lower and upper contact sections of the lower and upper contact terminals is equal to or slightly larger than the thickness of the front edge of a daughter board, thereby minimizing the insertion/removal force of the daughter board.

As the daughter board is rotated rearwardly, the upper and lower contact sections of the upper and lower contact terminals are moved downwardly and upwardly, respectively, thereby minimizing the vertical distance between the upper and lower contact sections of the upper and lower contact terminals.

Projections to secure a daughter board are integrated with the connector, thereby eliminating the need for any separate part or component.

BRIEF DESCRIPTION OF THE DRAWINGS

FIG. 4(*b*) is a sectional view taken along line 4—4 of FIG. 4(*a*);

FIG. 4(*c*) is a top plan view of the lock mechanism;

FIG. 5(*b*) is a sectional view taken along line 5—5 of FIG. 5(*a*);

FIG. 5(*c*) is a top plan view of the lock mechanism;

DESCRIPTION OF THE PREFERRED EMBODIMENT

Figure 1:
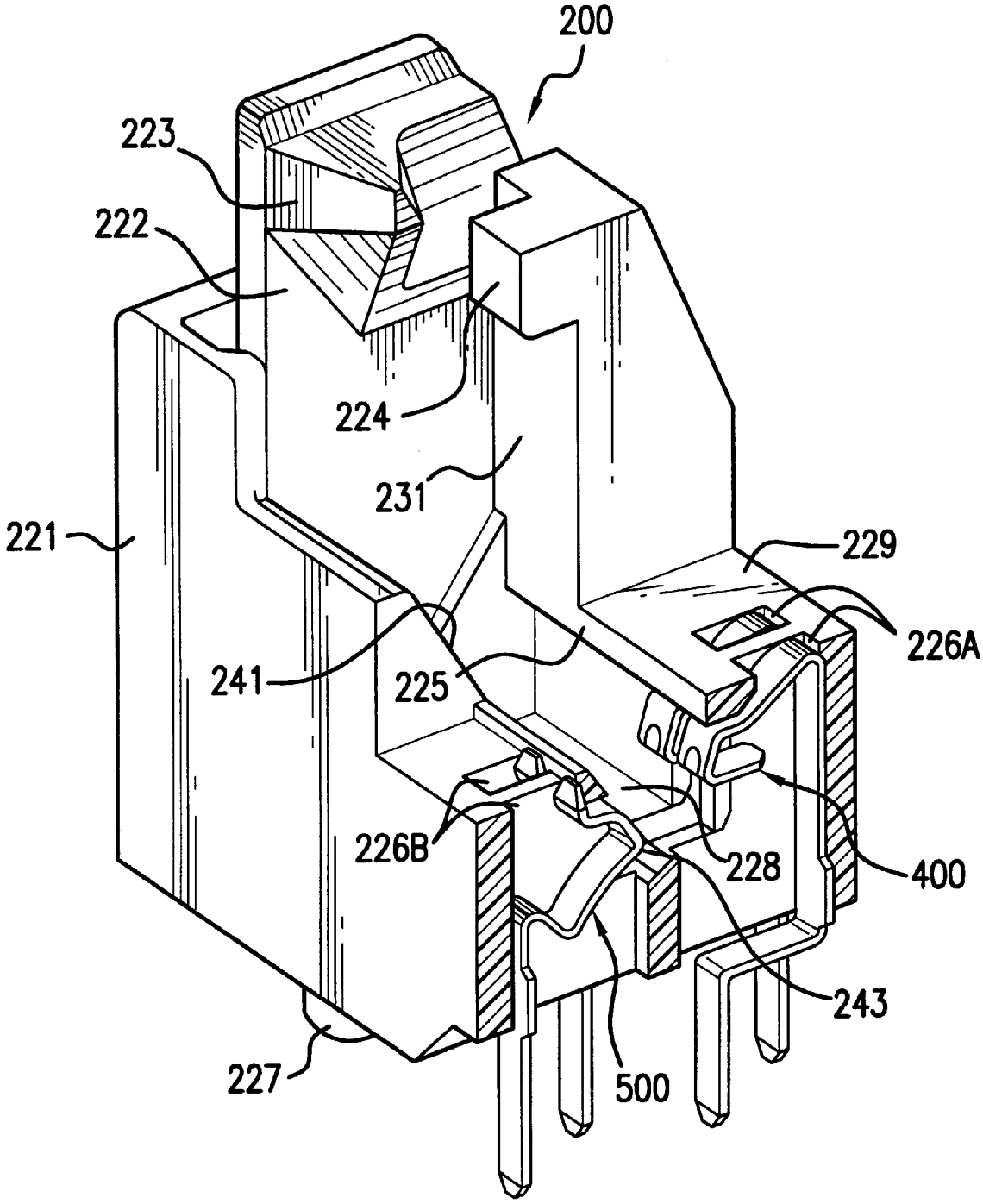
FIG. 1 is a perspective view of part of an electrical connector according to a first embodiment of the invention.

In FIG. 1, an electrical connector 200 includes an insulation housing 221 made by molding and a plurality of contact terminals 400 and 500. Upon assembling the connector, the contact terminals 400 and 500 are fixed to a base 229 of the housing 221. Then, the housing 221 is soldered to a mother board such that a guide post 227 of the housing 221 and the contact terminals 400 and 500 correspond to an aperture and a circuit pattern of the mother board, respectively.

The insulation housing 221 includes a slot 225 in the base 229, a latch lever 222, a latch portion 223, a post 231, and a projection 224. A plurality of contact terminal receiving apertures 226 are provided in the slot 225 for receiving the contact terminals 400 and 500 so as to provide an opening between contact sections 417 and 519 (FIG. 6) of the contact terminals 400 and 500 for receiving a daughter board.

Figure 2:
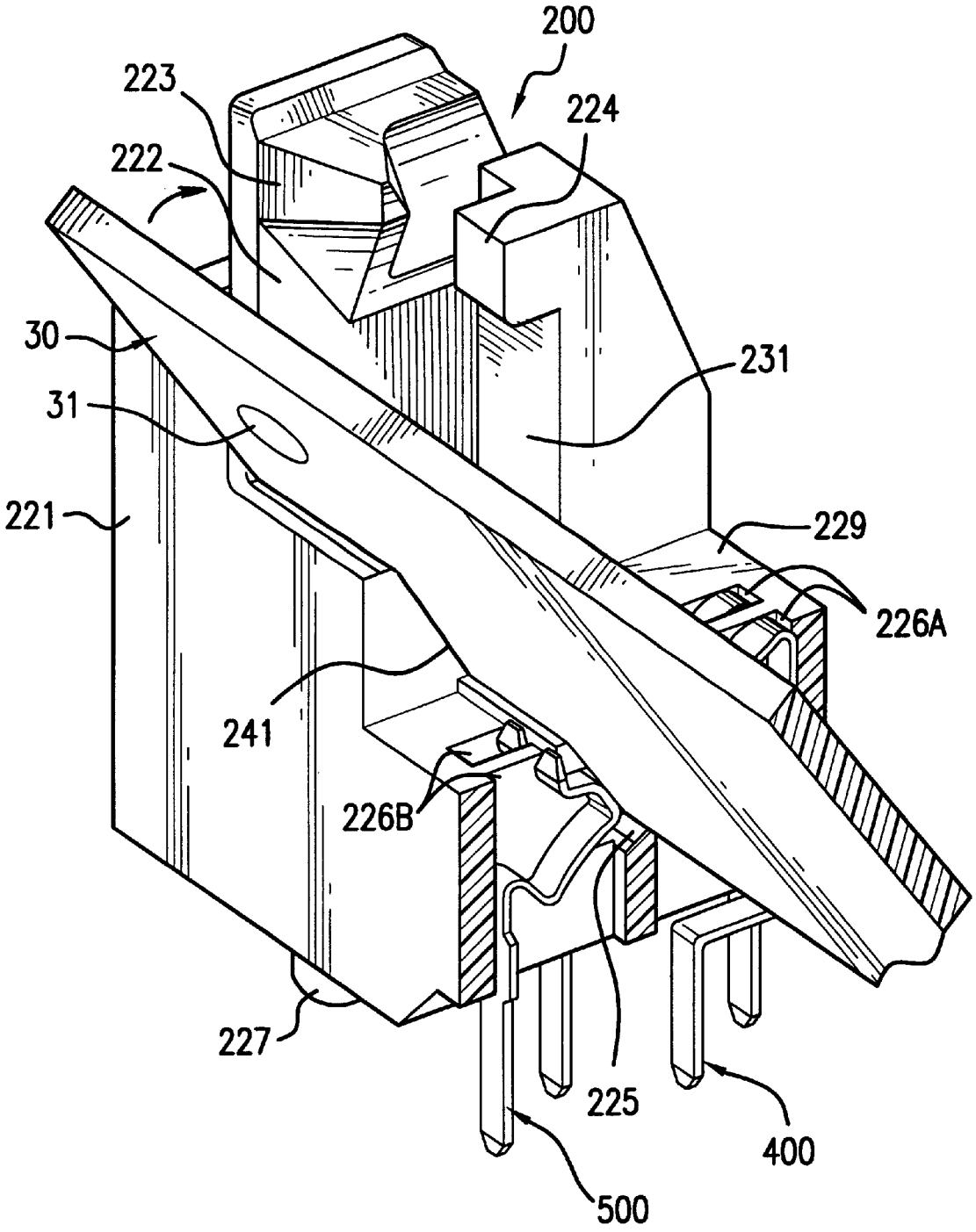
FIG. 2 is a perspective view of the electrical connector to which a daughter board is inserted.
Figure 3:
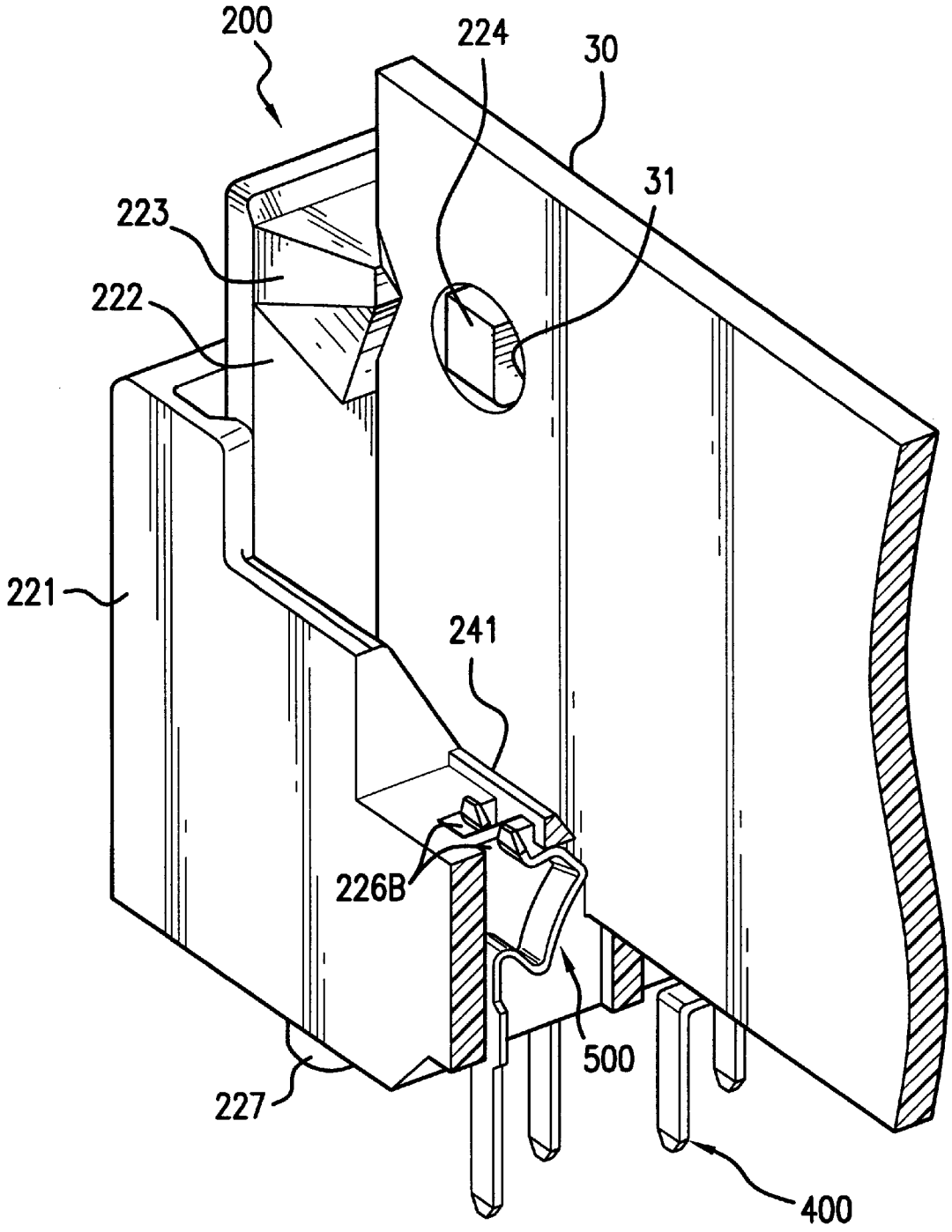
FIG. 3 is a perspective view of the electrical connector to which the daughter board is secured.

In FIGS. 2 and 3, a daughter board 30 is inserted into the opening or slot 225 and rotated rearwardly for securing the daughter board to the insulation housing 201. More specifically, the daughter board 30 is inserted obliquely into the opening along a sloping guide 241 of the housing 221 until a front edge of the daughter board 30 abuts against an inclined face 243 on the bottom of the slot 225. Then, the daughter board 30 is rotated rearwardly so that the side edges of the daughter board 30 engage the front faces of the latch portions 223 of latch levers 222. As the daughter board 30 is rotated, the latch levers 222 are flexed outwardly so that the daughter board 30 passes the latch portions 223. As a result, the latch levers 222 snap to the original positions to secure the daughter board 30 to the mother board at right angles. The daughter board 30 is supported between the latch portions 223 and rear posts 231. A pair of holes 31 in the daughter board 30 engage the projections 224 of the housing 221 to prevent the daughter board 30 from coming out of the housing 221.

Figure 4A:
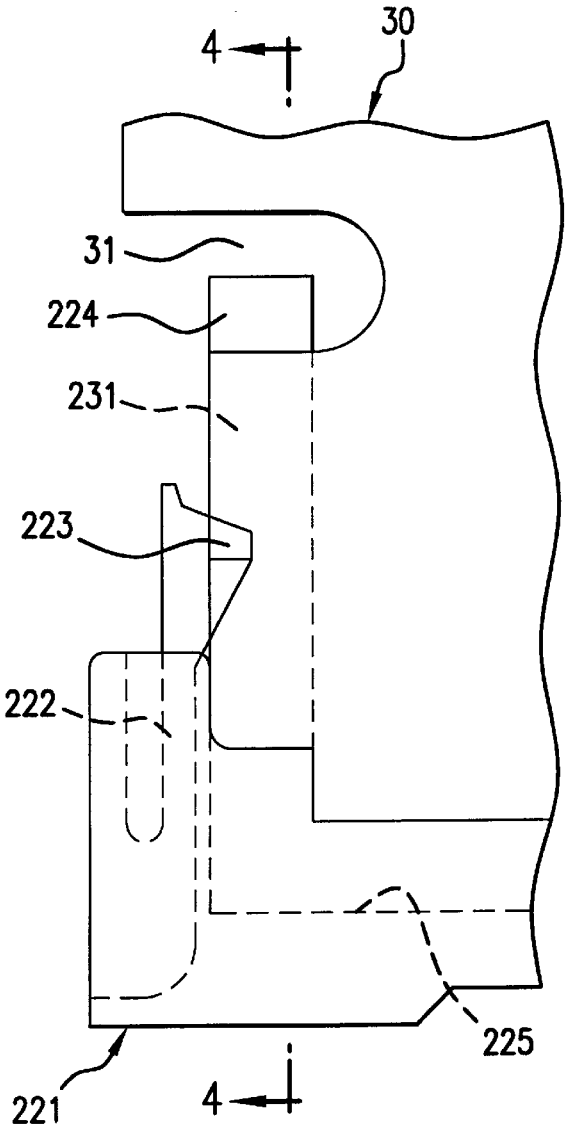
FIG. 4(*a*) is a front view of a lock mechanism according to a second embodiment of the invention.
Figure 4B:
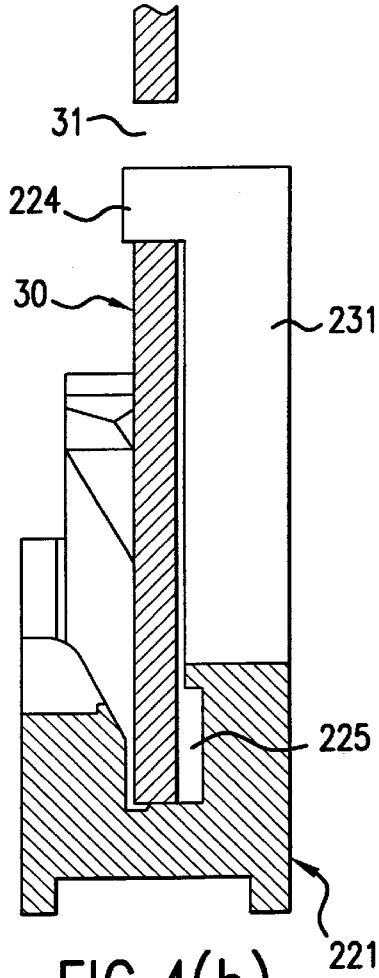
Figure 4C:
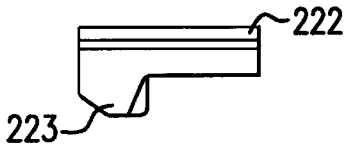

In FIGS. 4(*a*)–4(*c*), a projection 224 is provided at a position above the latch portion 223 so as to hold a large daughter board.

Figure 5A:
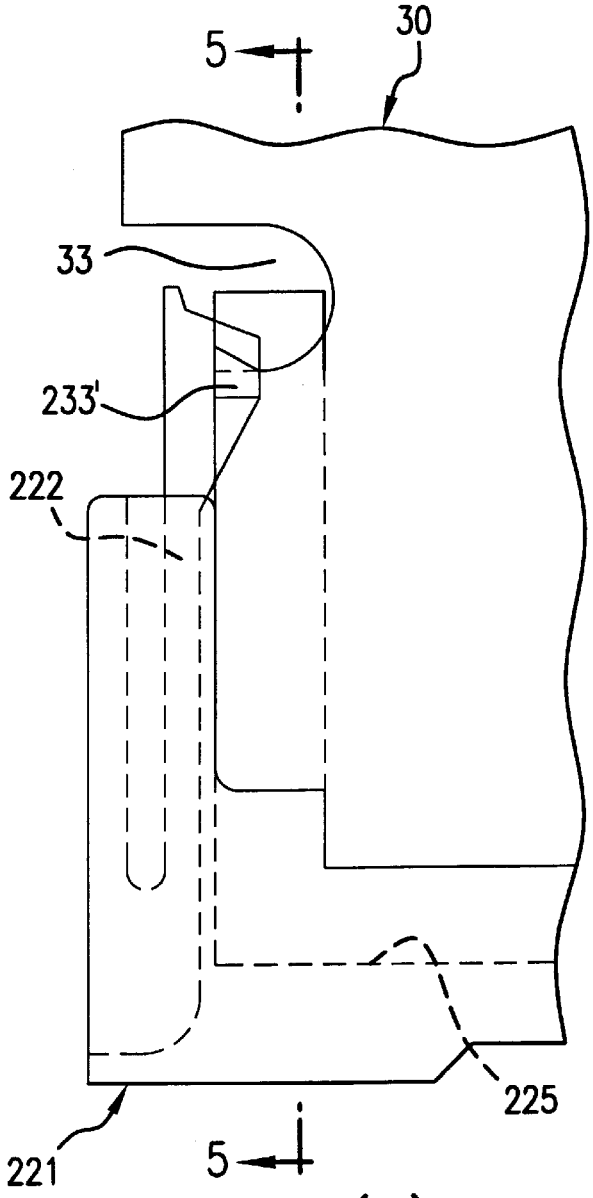
FIG. 5(*a*) is a front view of a lock mechanism according to a third embodiment of the invention.
Figure 5B:
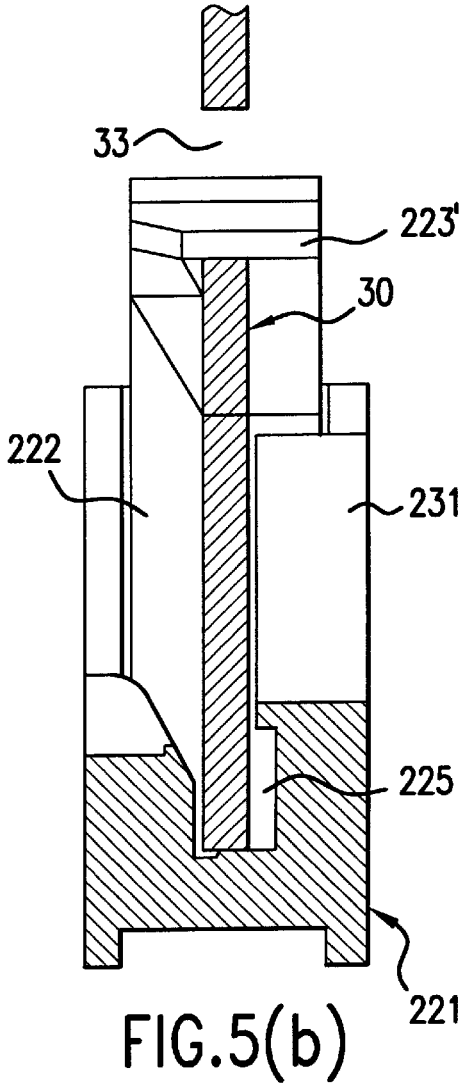
Figure 5C:
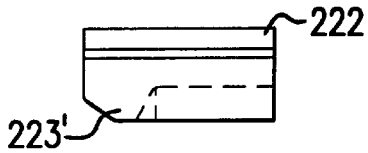

In FIGS. 5(*a*)–5(*c*), a projection and a latch portion are integrated at 223'. A semi-circular notch 33 is provided in the daughter board 30.

Figure 6:
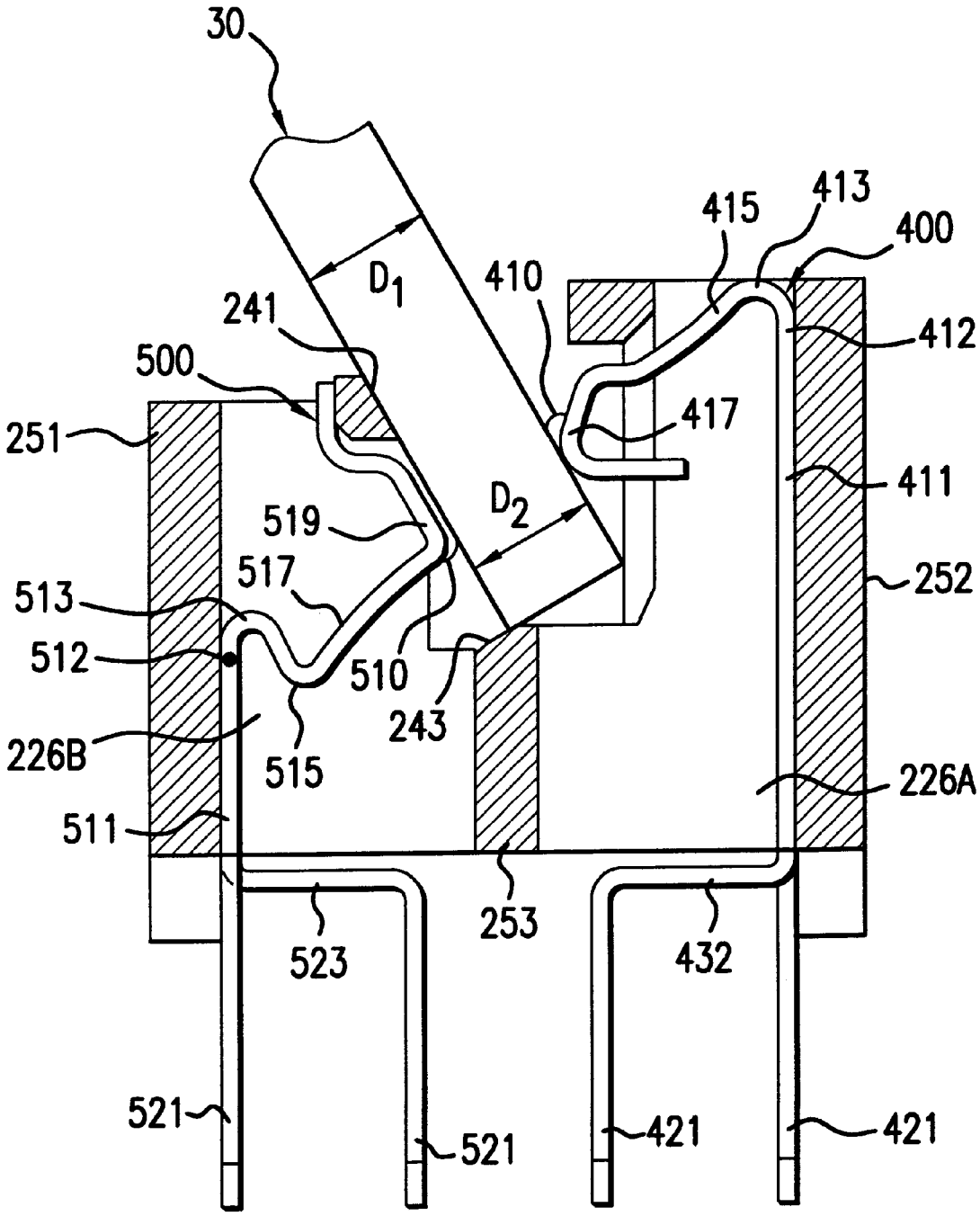
FIG. 6 is a sectional view of a slot for the electrical connector.

In FIG. 6, the contact terminals 400 and 500 are arranged in the slot 225 on either side of a central wall 253. The upper contact terminal 400 provided in the receiving aperture 226A on the side of a rear wall 252 of the housing 221 has a vertical section 411 extending along the rear wall 252, a U-shaped section 413, a curved section 415, and an upper contact section 417. The curved section 415 is curved downwardly. The lower contact terminal 500 provided in the receiving aperture 226 on the side of a front wall 251 of the housing 221 has a vertical section 511 extending upwardly to a middle point of the front wall 251, a reversed U-shaped section 513, a U-shaped portion 515, and a lower contact section 519. The curved section 517 is curved upwardly.

The lower halves of the upper and lower contact terminals 400 and 500 are inserted into apertures of the housing 221 so that the press-fitting sections are secured to the apertures. When the contact terminals 400 and 500 are press fitted to the apertures of the housing 221, the lower ends of the contact terminals project from the bottom of the housing 221. The housing 221 is soldered to the mother board such that the projected ends correspond to circuit traces of the mother board.

There are two types of each of the upper and lower contact terminals 400 and 500, depending on whether a crank section 432 or 523 is provided between the upper and lower halves. The two types of contact terminals are arranged alternately between the fixing (upper) and insertion (lower) sides so that when the contact terminal on the insertion (lower) side has a crank section, the contact terminal of the fixing (upper) side has no crank section.

The lower contact section 519 of the lower contact terminal 500 is lower than the upper contact section 417 of the upper contact terminal 400. The distance $D_2$ between the upper and lower contact sections 417 and 519 is equal to or slightly greater than the thickness $D_1$ of an edge of the daughter board 30. As a result, the resistance to insertion of the daughter board 30 into the opening is substantially zero so that it is possible to insert the daughter board 30 with a zero insertion force.

Figure 7:
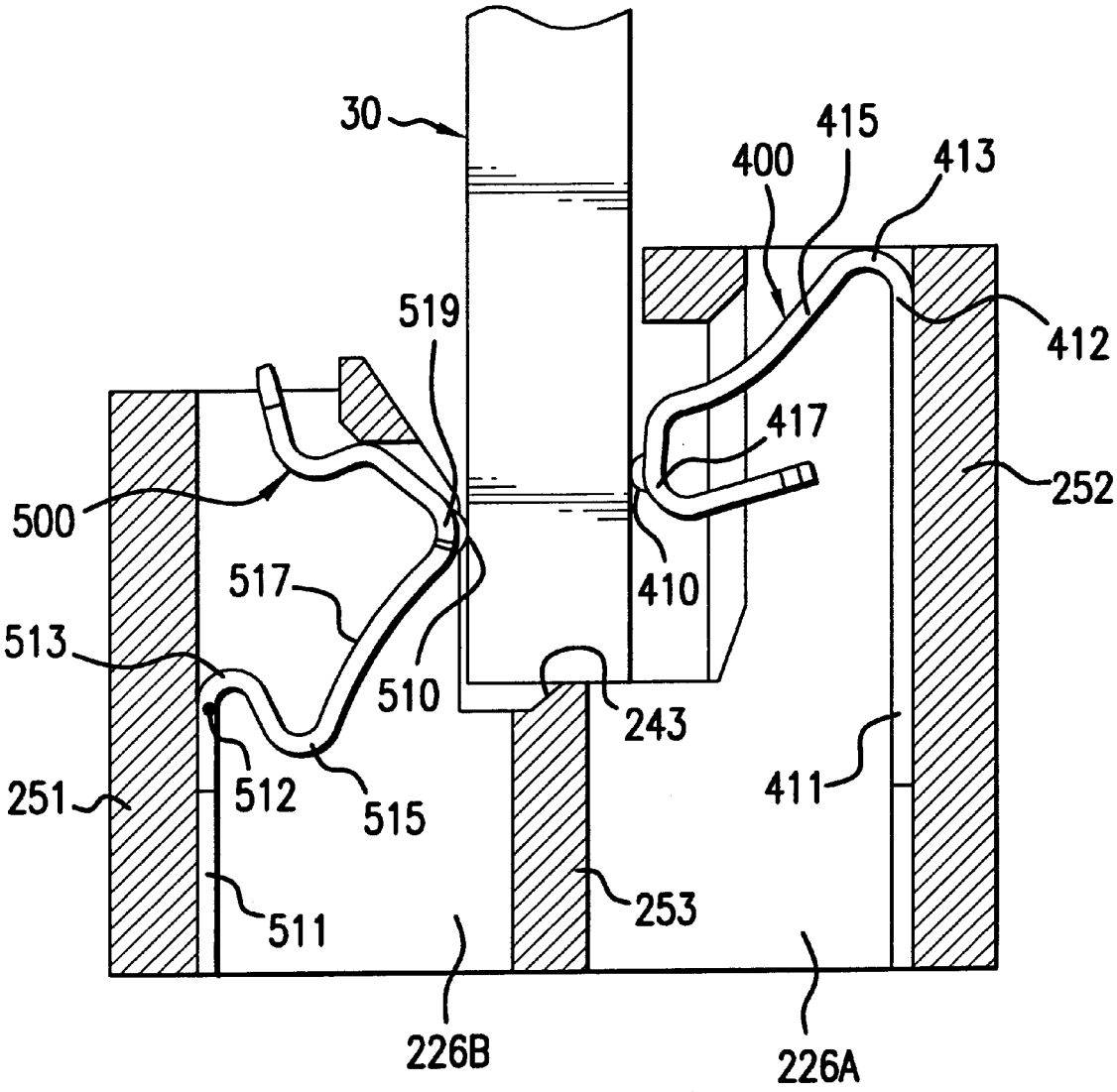
FIG. 7 is a sectional view of the slot wherein the daughter board is rotated rearwardly.

In FIG. 7, as the daughter board 30 is rotated rearwardly, the upper contact section 417 is turned counterclockwise about a point 412 while the lower contact section 519 of the lower contact terminal 500 is turned counterclockwise about a point 512. These circular movements are analyzed in terms of lateral and vertical movements.

Regarding the lateral movement, the upper contact section 417 and the lower contact section 519 are moved rearwardly and forwardly, respectively, so that the upper and lower contact sections 417 and 519 are brought into contact with the daughter board 30 with a predetermined contacting power.

Regarding the vertical movement, the upper and lower contact sections 417 and 519 are moved downwardly and upwardly, respectively, so that the "vertical distance" between the upper and lower contact sections 417 and 519 is reduced. When the upper contact section 417 is moved downwardly, the downwardly curved section 415 is straightened. Similarly, when the lower contact section 519 is moved upwardly, the upwardly curved section 517 is straightened. These straightening movements further reduce the vertical distance. For example, the vertical distance is reduced by about 0.69 mm from about 1.18 mm before the movement to about 0.49 mm after the movement. As the vertical distance decreases, the moment of rotation upon the daughter board decreases. Rounded portions 410 and 510 are provided on the upper and lower contact sections 417 and 519 to facilitate the movements and contact with the pads of the daughter board 30.

Figure 8:
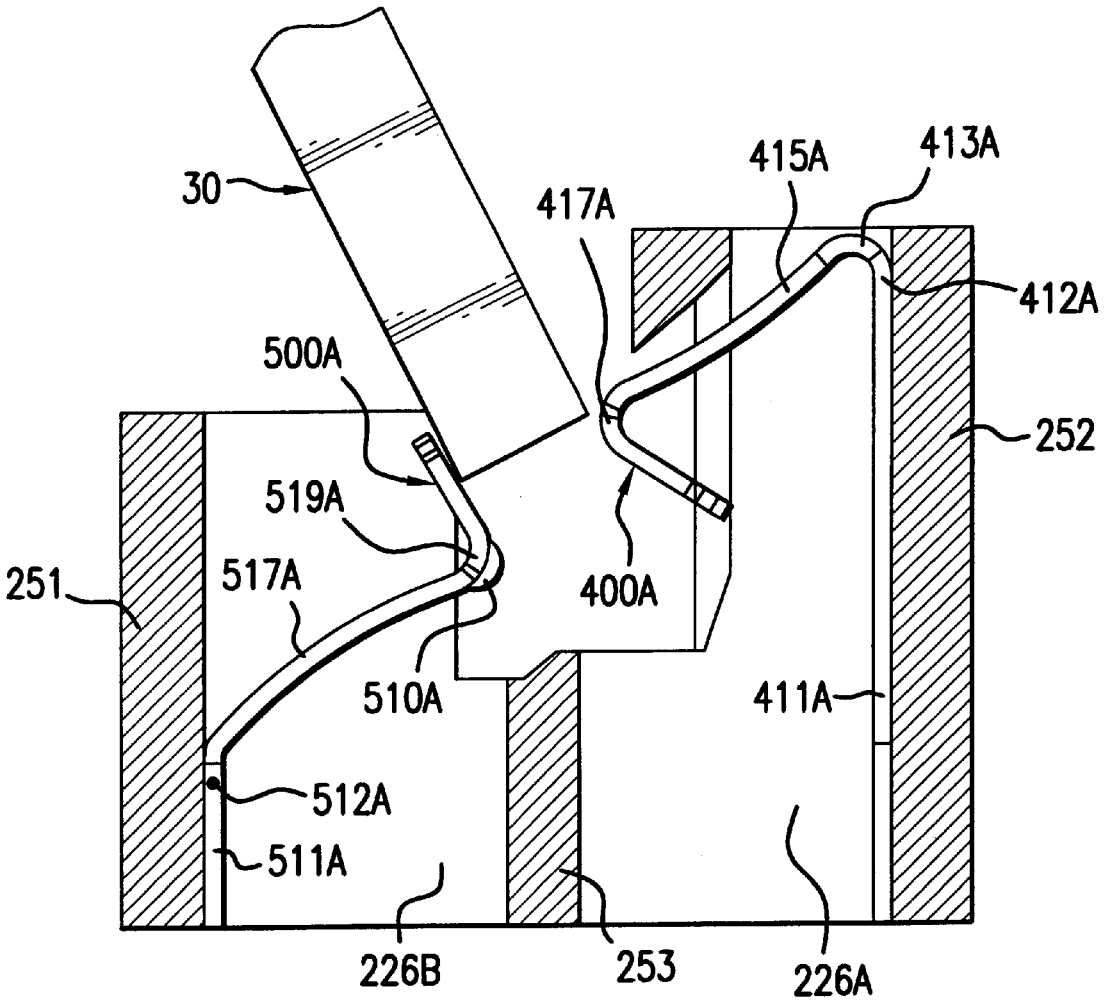
FIG. 8 is a side view of contact terminals according to a fourth embodiment of the invention.

In FIG. 8, an upper contact terminal 400A includes a vertical section 411A extending upwardly along the rear wall 252, an inverted U-shaped section 413A, an upwardly curved section 415A, and an upper contact section 417A. A lower contact terminal 500A includes a vertical section 511A extending upwardly to a middle point of the front wall 251, a downwardly curved section 517A, and a lower contact section 519A. A rounded portion 510A is provided on only the lower contact section 519A.

As the daughter board is rotated, the upper contact section 417A is turned counterclockwise about a point 412A while the lower contact section 519A is turned counterclockwise about a point 512A. As a result, the upper contact section 417A is moved rearwardly while the lower contact section 519A is moved forwardly so that it is possible to hold the daughter board between the contact sections 417A and 519A. The upper and lower contact sections 417A and 519A are moved downwardly and upwardly, respectively, so that the vertical distance between the upper and lower contact sections 417A and 519A is reduced.

Figure 9:
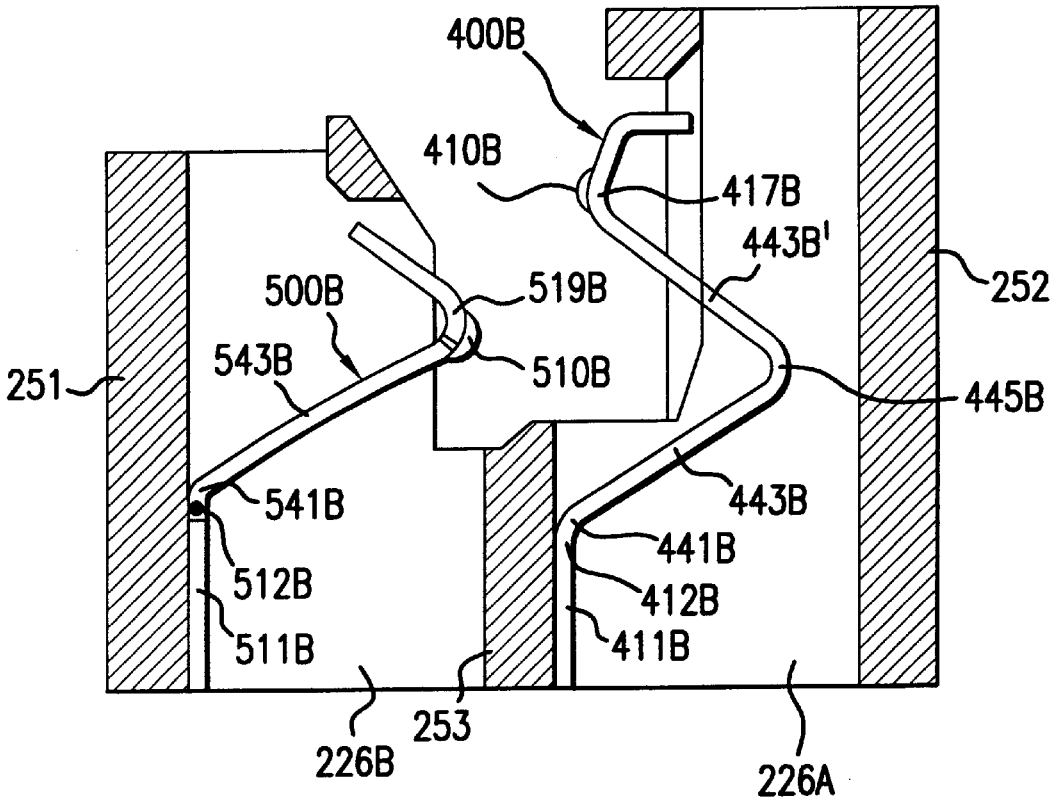
FIG. 9 is a side view of contact terminals according to a fifth embodiment of the invention.

In FIG. 9, an upper contact terminal 400B includes a vertical section 411B extending up to a middle point of a central wall 253, a curved section 441B bent toward the fixing side, a straight section 443B, a curved section 445B bent toward the insertion side, a straight section 443B', and an upper contact section 417B. A lower contact terminal 500B includes a vertical section 511B extending up to a middle point of a front wall 251, a curved section 541B bent toward the fixing side, a straight section 543B, and a lower contact section 519B. Rounded portions 410B and 510B are provided on the upper and lower contact terminals 400B and 500B, respectively.

As the daughter board is rotated, the upper contact section 417B is turned clockwise about a point 412B while the lower contact section 519B is turned counterclockwise about a point 512B. As a result, the upper contact section 417B is moved rearwardly while the lower contact section 519B is moved forwardly so that it is possible to hold the daughter board between the contact sections 417B and 519B. Also, the upper contact section 417B is moved downwardly while the lower contact section 519B is moved upwardly so that the distance between the upper and lower contact sections 417B and 519B is reduced.

Figure 10:
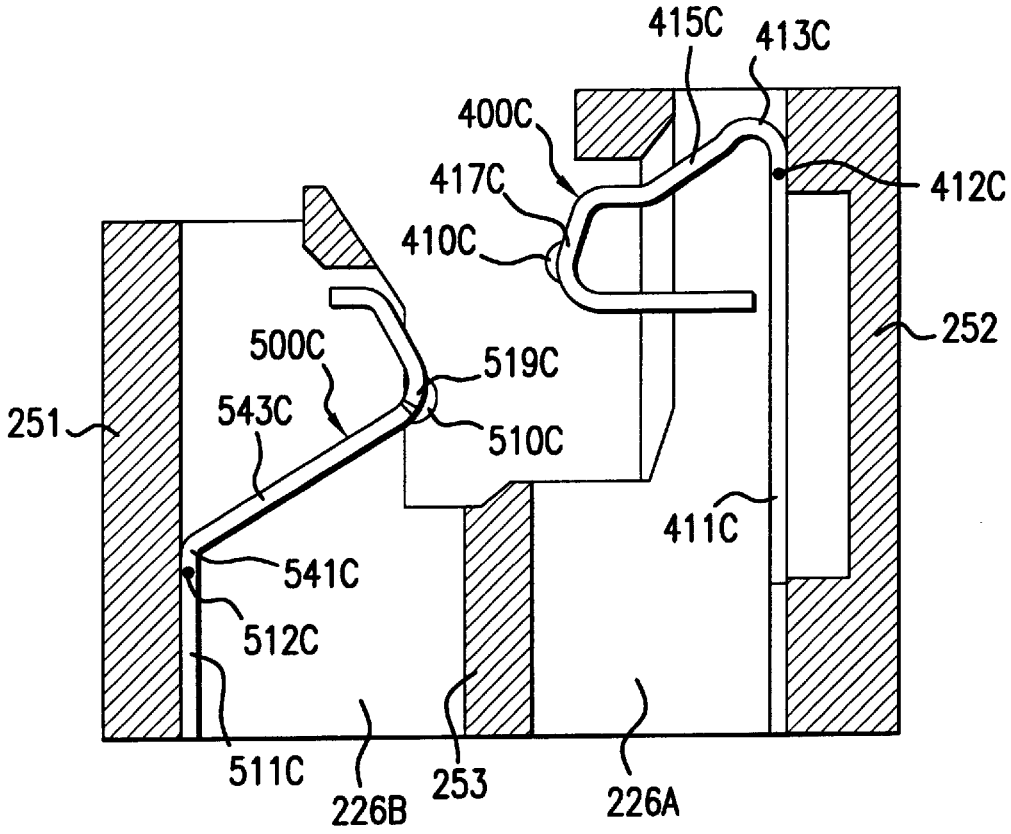
FIG. 10 is a side view of contact terminals according to a sixth embodiment of the invention.

In FIG. 10, an upper contact terminal 400C has a vertical section 411C extending up to almost the top of a rear wall 252, a curved section 413C bent toward the insertion side, an upwardly curved section 415C, an upper contact section 417C, and an end section extending laterally to the vertical section 411C. A lower contact terminal 500C has a vertical section 511C extending up to a middle point of a front wall 251, a curved section 541C bent toward the fixing side, a straight section 543C, and a lower contact section 519C. Only opposite ends of the vertical section 411C contact the rear wall 252 so that the intermediate portion is spaced from the rear wall 252. Consequently, the vertical section 411C is able to bend rearwardly. Rounded portions 410C and 510C are provided on both the upper and lower contact terminals 400C and 500C.

As the daughter board is rotated, the upper and lower contact sections 417C and 519C are turned counterclockwise about points 412C and 512C, respectively, so that the upper and lower contact sections 417C and 519C are moved rearwardly and forwardly, respectively, making it possible to hold the daughter board between the contact sections 417C and 512C. Also, the upper and lower contact sections 417C and 512C are moved downwardly and upwardly, respectively, thereby reducing the vertical distance between the upper and lower contact sections 417C and 519C.

When the upper contact section 417C is moved downwardly, the vertical section 411C is bent rearwardly so that the upper contact section 417C is moved further downwardly. When the upper contact section 417C is moved downwardly, the lateral end portion abuts against the vertical section 411C and bends it rearwardly so that the upper contact section 417C is moved further downwardly. Consequently, the vertical distance is further reduced.

Alternatively, the upper and lower contact terminals may be arranged in a zigzag fashion or offset by a half pitch from each other.

As has been described above, when the daughter board is rotated rearwardly, the upper and lower contact sections are moved downwardly and upwardly, respectively, so that the vertical distance between the upper and lower contact sections is reduced. Consequently, the moment of rotation on the daughter board by the contact terminals is minimized so that not only warping of the daughter board is minimized but also a stable contact between the daughter board and the contact terminals is provided.

Since the zero-insertion rotation-lock mechanism is used, the insertion or removal force of the daughter board is minimized, and more contact terminals are provided in the connector. In addition, it is possible to prevent the daughter board from coming out of the connector without increasing the number of parts or the manufacturing costs.

What is claimed is:

1. An electrical connector (200) for connecting a daughter board (30) to a mother board, comprising:

an insulation housing (221) to be mounted on said mother board and having a slot (225) for receiving said daughter board and a pair of front and rear rows of terminal receiving apertures (226B, 226A); and a plurality of short and long contact terminals (500, 400) provided in said front and rear terminal receiving aperture, respectively, and having lower and upper contact sections (519, 417), respectively, such that a vertical distance between said lower and upper contact sections is reduced after said daughter board is rotated rearwardly so that the moment of rotation upon said daughter board caused by said vertical distance is minimized, wherein said short contact terminal (500) has a vertical section (511) extending upwardly along a front wall (251) of said insulation housing up to substantially a half height of said front wall, a first curved section (513) extending downwardly from said vertical section (511), a second curved section (515) extending upwardly from said first curved section and curved with an acute angle and said lower contact section (519) extending from said curved section such that said lower contact section is turned counterclockwise at a top end (512) of said vertical section (511) of said short contact terminal when said daughter board is rotated rearwardly, and said long contact terminal (400) has a vertical section (411) extending upwardly along a rear wall (252) of said insulation housing up to substantially the same height of said rear wall, an inverted U-shaped section (413) extending from said vertical section (411) and curved with an acute angle and said upper contact section (417) extending from the curved contact section (415) such that said upper contact section is turned counterclockwise at a top end (412) of said vertical section of said upper contact terminal when said daughter board is rotated rearwardly, thus reducing said vertical distance between said lower and upper contact sections.

2. An electrical connector according to claim 1, wherein at least one of said upper and lower contact sections is provided with a rounded portion.

3. An electrical connector (200) for connecting a daughter board (30) to a mother board, comprising:

an insulation housing (221) to be mounted on said mother board and having a slot (225) for receiving said daughter board and a pair of front and rear rows of terminal receiving apertures (226B, 226A); and a plurality of short and long contact terminals (500, 400) provided in said front and rear terminal receiving aperture, respectively, and having lower and upper contact sections (519, 417), respectively, wherein said short contact terminal (500B) has a vertical section (511B) extending upwardly along a front wall (251) of said insulation housing up to substantially a half height of said front wall (251), a first curved section (541B) bent toward a central wall (253) with an acute angle from said front wall, and an inclined straight section (543B) extending between said first curved section (541B) and said lower contact section (519B) such that said lower contact section is turned counterclockwise at a top end (512B) of said vertical section of said short contact terminal when said daughter board is rotated rearwardly, and said long contact terminal (400B) has a vertical section (411B) extending upwardly along said central wall (253) of said insulation housing up to substantially a half height of said central wall, a first curved section (441B) extending from said vertical section, a first inclined straight section (443B) extending between said first curved section and a second curved section (445B), a second inclined straight section (443B') extending between said second curved section and said upper contact section (417B) such that said upper contact section is turned clockwise at a top end (412B) of said vertical section of said long contact terminal when said daughter board is rotated rearwardly, thus reducing said vertical distance between said lower and upper contact sections.

4. An electrical connector (200) according to claim 1, wherein said rear wall (252) is provided with a space between said rear wall and said vertical section (411C) of said long contact terminal (400C) at an intermediate part of said rear wall so that said vertical section is pushed rearwardly into said space by a lateral end of said upper contact section when said daughter board is rotated rearwardly, thereby further reducing said vertical distance between said lower and upper contact sections.

* * * * *